US007958941B2

(12) United States Patent
Hueston et al.

(10) Patent No.: US 7,958,941 B2
(45) Date of Patent: Jun. 14, 2011

(54) HYDRAULIC RUNNING TOOL ASSEMBLY AND METHOD OF ITS USE

(75) Inventors: Kenneth J Hueston, Edmonton (CA); Brian K Klimack, Tofield (CA); Michael Shoyhetman, Edmonton (CA)

(73) Assignee: Sturni-Hueston Engineering Ltd., Edmonton (CA)

( * ) Notice: Subject to any disclaimer, the term of this patent is extended or adjusted under 35 U.S.C. 154(b) by 119 days.

(21) Appl. No.: 12/255,601

(22) Filed: Oct. 21, 2008

(65) Prior Publication Data

US 2010/0096123 A1 Apr. 22, 2010

Related U.S. Application Data

(60) Provisional application No. 61/021,325, filed on Jan. 15, 2008.

(51) Int. Cl.
*E21B 23/04* (2006.01)

(52) U.S. Cl. ..... 166/382; 166/123; 166/208; 166/212

(58) Field of Classification Search ..... 166/382, 166/125, 123, 208, 212
See application file for complete search history.

(56) References Cited

U.S. PATENT DOCUMENTS

| | | | | |
|---|---|---|---|---|
| 3,291,229 | A * | 12/1966 | Houston | 175/60 |
| 3,608,634 | A | 9/1971 | Cochran | |
| 4,096,913 | A | 6/1978 | Kenneday et al. | |
| 4,311,194 | A | 1/1982 | White | |
| 4,441,559 | A | 4/1984 | Evans et al. | |
| 4,516,634 | A | 5/1985 | Pitts | |
| 4,583,593 | A * | 4/1986 | Zunkel et al. | 166/382 |
| 4,828,037 | A * | 5/1989 | Lindsey et al. | 166/382 |
| 4,911,237 | A * | 3/1990 | Melenyzer | 166/208 |
| 5,086,844 | A | 2/1992 | Mims et al. | |
| 5,318,131 | A * | 6/1994 | Baker | 166/382 |
| 5,375,662 | A | 12/1994 | Echols, III et al. | |
| 5,579,840 | A | 12/1996 | Saurer | |
| 5,794,694 | A | 8/1998 | Smith, Jr. | |
| 6,116,339 | A | 9/2000 | Milne et al. | |
| 6,167,970 | B1 | 1/2001 | Stout et al. | |
| 6,739,398 | B1 | 5/2004 | Yokley et al. | |

FOREIGN PATENT DOCUMENTS

GB 2280462 A 1/1995

* cited by examiner

*Primary Examiner* — Hoang Dang
(74) *Attorney, Agent, or Firm* — Stephen R. Burri

(57) ABSTRACT

An assembly and method for downhole equipment deployment comprising a liner hanger attachable to deployable equipment, a top sub insertable into the liner hanger and attachable to a tubing string, a lock piston releasably connectable to the top sub, and lock pins insertable through the top sub, the liner hanger, and the lock piston, the liner hanger and associated equipment remotely releasable from the top sub and the lock piston.

18 Claims, 13 Drawing Sheets

HYDRAULIC RUNNING TOOL ASSEMBLY AND METHOD OF ITS USE

TECHNICAL FIELD OF THE INVENTION

The present invention relates to running tools for drilling and completion operations. In particular, the present invention relates to an obstructed bore hydraulic running tool with optional mechanical activation.

BACKGROUND OF THE INVENTION

It is known to provide running tools, including obstructed bore running tools for drilling operations. Such running tools often include slips, dogs, or latches that restrict axial movement during deployment, but are prone to slippage or dragging, which may cause damage to the interior bore of the casing. Prior art running tools are also prone to premature release, increasing deployment time thereby reducing deployment efficiency.

It is desirable to provide a running tool assembly which does not employ slips, dogs or latches, and does not suffer from premature release. The present invention meets these objectives.

SUMMARY OF THE INVENTION

There is provided an assembly for downhole equipment deployment, comprising a liner hanger having a wall and a bore, a plurality of pin holes through the wall equidistant from the uphole end of the liner hanger, and means for attachment of the downhole end of the liner hanger to the uphole end of deployable equipment; a top sub having a wall, a throat section at its downhole end and a plurality of pin holes through the wall in the throat section, the pin holes alignable with the corresponding pin holes of the liner hanger, the downhole end of the top sub insertable into the uphole end of the liner hanger, and the uphole end of the top sub attachable to the downhole end of a string by top sub string attachment means; a lock piston having at its downhole end a plurality of collet fingers with a slot defined between each pair of adjacent collet fingers, the downhole end of each slot having a pin entrance with a first width greater than the width of the remainder of the slot, each of the pin entrances alignable with corresponding pin holes of the top sub and liner hanger, the lock piston insertable into the throat section of the top sub with the collet fingers oriented downhole, wherein the circumference of the lock piston at the position of the pin entrances is greater than its circumference at the position of the uphole end of the slot; a plurality of lock pins, insertable through the pin holes of the top sub, the pin holes of the liner hanger, and the pin entrances of the slots of the lock piston; means for releasably connecting the top sub and the lock piston; and means for remotely releasing the liner hanger from the top sub and the lock piston.

The means for releasably connecting the top sub and the lock piston may comprise a plurality of screw holes through the outer wall of the liner hanger, a plurality of corresponding screw holes in the outer surface of the lock piston, and a plurality of shearable screws insertable through the screw holes of the top sub into the screw holes of the lock piston.

The shearable screws may be manufactured of brass. The diameter of the bore may be between 4.068 inches and 7.983 inches, in a casing having characteristics of 4½Ø×9.50 lbf/ft thru 9⅝Ø×75.60 lbf/ft. Preferably, the diameter of the bore may be between 4.535 inches and 6.337 inches in a casing having characteristics of 5.0Ø×11.50 lbf/ft thru 7⅝Ø×47.10 lbf/ft.

The plurality of pin holes in the liner hanger and the top sub may comprise four pin holes.

The means for attachment of the downhole end of the liner hanger to the uphole end of deployable equipment may be any attachment means, including a threaded male (pin) connection means. The top sub string attachment means may comprise any attachment means, including a threaded female (box) connection means.

The plurality of collet fingers may comprise four collet fingers. The downhole ends of the collet fingers of the lock piston may join to form an annular downhole lock piston terminus.

The means for remotely releasing the liner hanger from the top sub and the lock piston may comprise mechanical means. The mechanical means for remotely releasing the liner hanger from the top sub and the lock piston may comprise a mechanical activation component disposed between the uphole end of the top sub and the downhole end of the string, the mechanical activation component threadably insertable into the top sub to effect release of the lock piston from the top sub. The means for remotely releasing the liner hanger from the top sub and the lock piston may instead comprise hydraulic means.

The top sub may further comprise at least one hydraulic fluid drain disposed in a position which is downhole of the uphole end of the lock piston when the lock piston is in a pre-activation position, and uphole of the uphole end of the lock piston when the lock piston is substantially in an activated position; the hydraulic activation means may comprise an activation ball disposable into the hole to a position in proximity to the uphole end of the lock piston; and a supply of pressurized hydraulic fluid for seating the ball in the mouth of the lock piston.

There is further provided a method of operating a running tool assembly for deploying downhole equipment from the surface, comprising the following steps: assembling a liner hanger, top sub, lock piston, lock pins, shear screws and seals into a running tool assembly; attaching the assembly to a tubing string; inserting the assembly into a selected hole to a desired depth; dropping an activation ball downhole; pumping hydraulic fluid from the surface to seat the ball, increase annulus string pressure, shear screws holding the lock piston to the top sub, drive the lock piston into the liner hanger, and retract the lock pins holding the liner hanger to the top sub; retrieving the assembly apart from the liner hanger by pulling the tubing string out of the hole. The method of operating a running tool assembly may further comprise the additional final step of refitting the assembly.

A method of operating a running tool assembly for deploying downhole equipment from the surface, may comprise the following steps: assembling a liner hanger, top sub, lock piston, lock pins, shear screws and seals into a running tool assembly; attaching the assembly to a tubing string; inserting the assembly into a selected hole to a desired depth; rotating the string to mechanically shear screws holding the lock piston to the top sub, drive the lock piston into the liner hanger, and retract the lock pins holding the liner hanger to the top sub; retrieving the assembly apart from the liner hanger by pulling the tubing string out of the hole. The hydraulic fluid may be in a gas phase.

There is also provided use of the assembly as described downhole deployment of equipment. The downhole deployment of equipment may be in any industry, not limited to oil and gas drilling and completion.

One advantage of the present invention is in the use of obstructed bore technology to restrict potentially hazardous downhole debris from entering the lower portion of the string, thereby avoiding potentially damage to the seating area of the tool.

Another advantage of the present invention is the ability to activate the tooling in either a state of compression or tension of the string.

Another advantage of the present invention is the choice of deployment method between hydraulic activation and mechanical activation, the latter providing a back-up system for downhole equipment release should hydraulic activation not be an option.

Other advantages of the present invention include the ease of field dressing for return to service, and simple maintenance requirements.

A further advantage of the present invention is the retrievability of the entire assembly except for the liner hanger, also known as a liner hanger, leaving a minimum of steel downhole.

BRIEF DESCRIPTION OF THE INVENTION

A detailed description of the preferred embodiments is provided by way of example only and with reference to the following drawings, in which.

Figure 1:
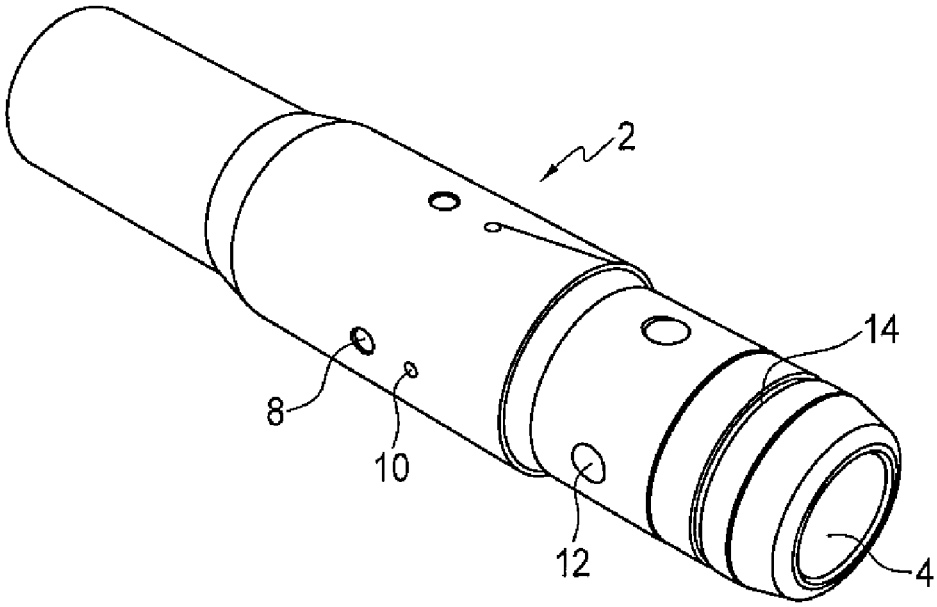
FIG. 1 is a perspective view of a top sub of the assembly, according to the invention.

In the drawings, one embodiment of the invention is illustrated by way of example. It is to be expressly understood that the description and drawings are only for the purpose of illustration and as an aid to understanding, which are not intended as a definition of the limits of the invention.

DETAILED DESCRIPTION OF THE INVENTION

According to one embodiment of the present invention, there is provided a tubular obstructed bore assembly used for downhole equipment deployment in the oil & gas industry. The assembly is designed to be run into an equipment deployment target zone on a tubing string. The assembly may be activated hydraulically by a ball drop, or mechanically by left-hand string rotation. Activation may be accomplished while the string is in tension or compression. The assembly is substantially retrievable, and may be quickly field dressed for return to service.

The assembly, according to one embodiment of the present invention, comprises several components, including a top sub, a lock piston, a liner hanger, lock pins, shear screws, and seals.

Figure 2:
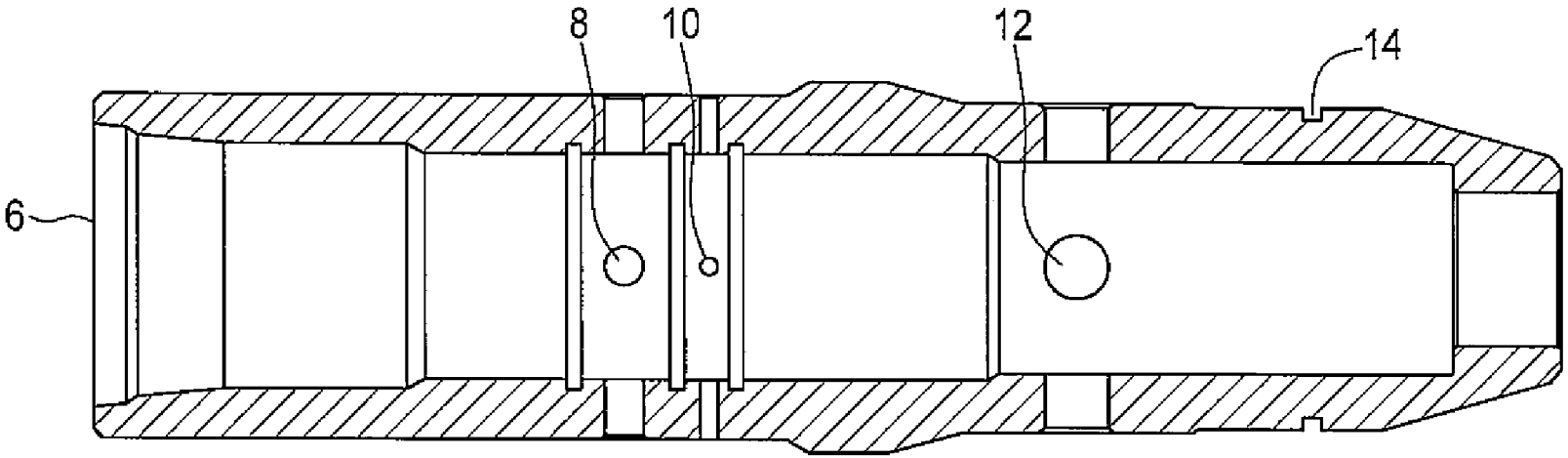
FIG. 2 is a cross-sectional view of a top sub of the assembly, according to the invention.

As depicted in FIGS. 1 and 2, the top sub 2 is a cylindrical component having a longitudinal bore 4 of varying diameter. A throat 6 at the uphole end of the top sub has the widest bore. The top sub has several sets of lateral holes perpendicular to the longitudinal bore passing through the wall of the top sub. A first set of lateral holes, hydraulic fluid drain holes 8, is situated at position along the top sub uphole of the uppermost end of the lock piston when the lock piston is in an activated position. A second set of lateral holes, threaded screw holes 10, is situated at a medial position along the top sub downhole of the drain holes. A third set of lateral holes, lock pin holes 12, is situated at a medial position downhole of the screw holes. The top sub further comprises an external channel 14 for receiving a pliable annular seal for sealing the joint between the top sub and the liner hanger.

Figure 3:
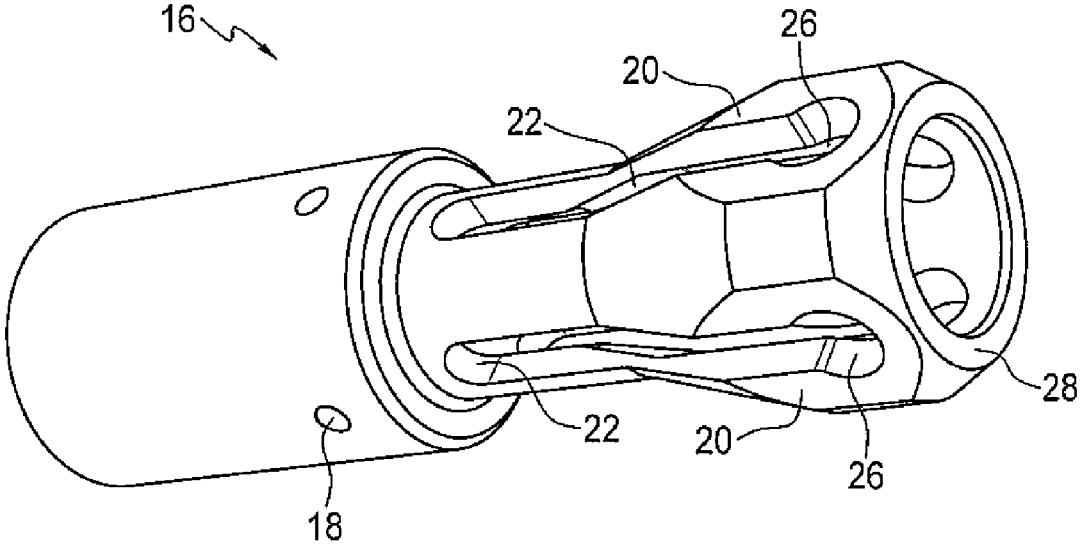
FIG. 3 is a perspective view of a lock piston of the assembly, according to the invention.
Figure 4:
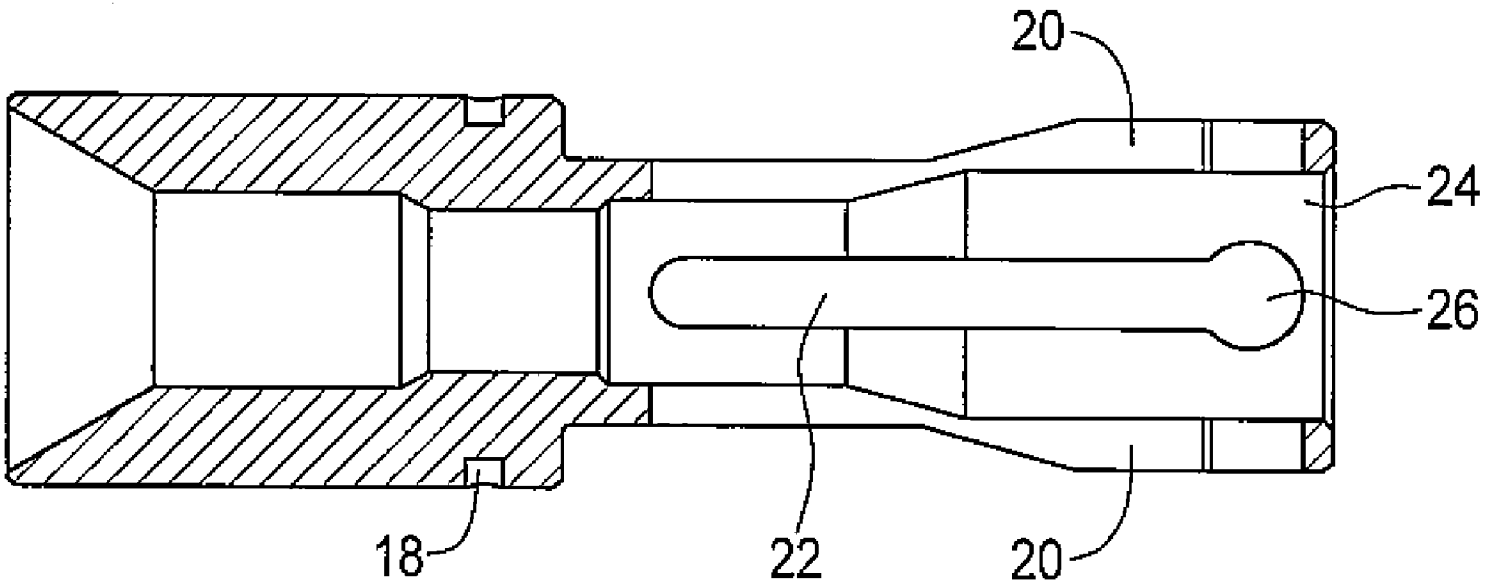
FIG. 4 is a cross-sectional view of a lock piston of the assembly, according to the invention.

As depicted in FIGS. 3 and 4, the lock piston 16 has, according to one embodiment of the present invention, biased towards the uphole end of the lock piston, a plurality of counterbore holes 18 corresponding to the threaded holes of the top sub. Extending from a medial position of the lock piston to the downhole end of the lock piston there are a plurality of collet fingers 20 defining a plurality of slots 22 between the collet fingers. In a preferred embodiment, the downhole ends of the collet fingers are joined to form an annular terminus 24. The closed slot design of the lock piston is preferred as the closed slot design is effective in preventing the reverse motion of the lock piston and possible blow back under conditions of high formation pressure. In addition, the closed slots provide increased strength to the collet fingers. In an alternate embodiment, the collet fingers may be independent at the downhole terminus.

A pin entrance 26 at the downhole end of each slot has a width sufficient to receive the head of a lock pin. The remainder of each slot extending longitudinally from the pin entrance has a width less than the width of a lock pin head greater than the width of a lock pin neck, and less than the width of a lock pin shoulder. The downhole end 28 of the lock piston has a diameter substantially equal to the uphole end of the lock piston. A medial section of the lock piston where the collet fingers extend begin has a narrower diameter. From the pin entrance, the lock piston diameter decreases towards the uphole end of the collet fingers.

Figure 5:
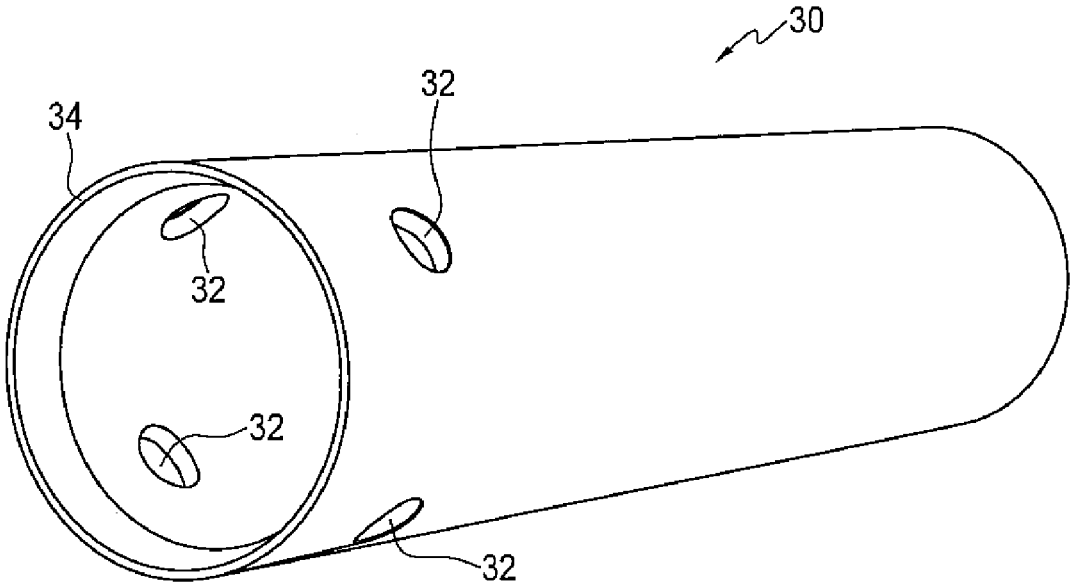
FIG. 5 is a perspective view of a liner hanger of the assembly, according to the invention.
Figure 6:
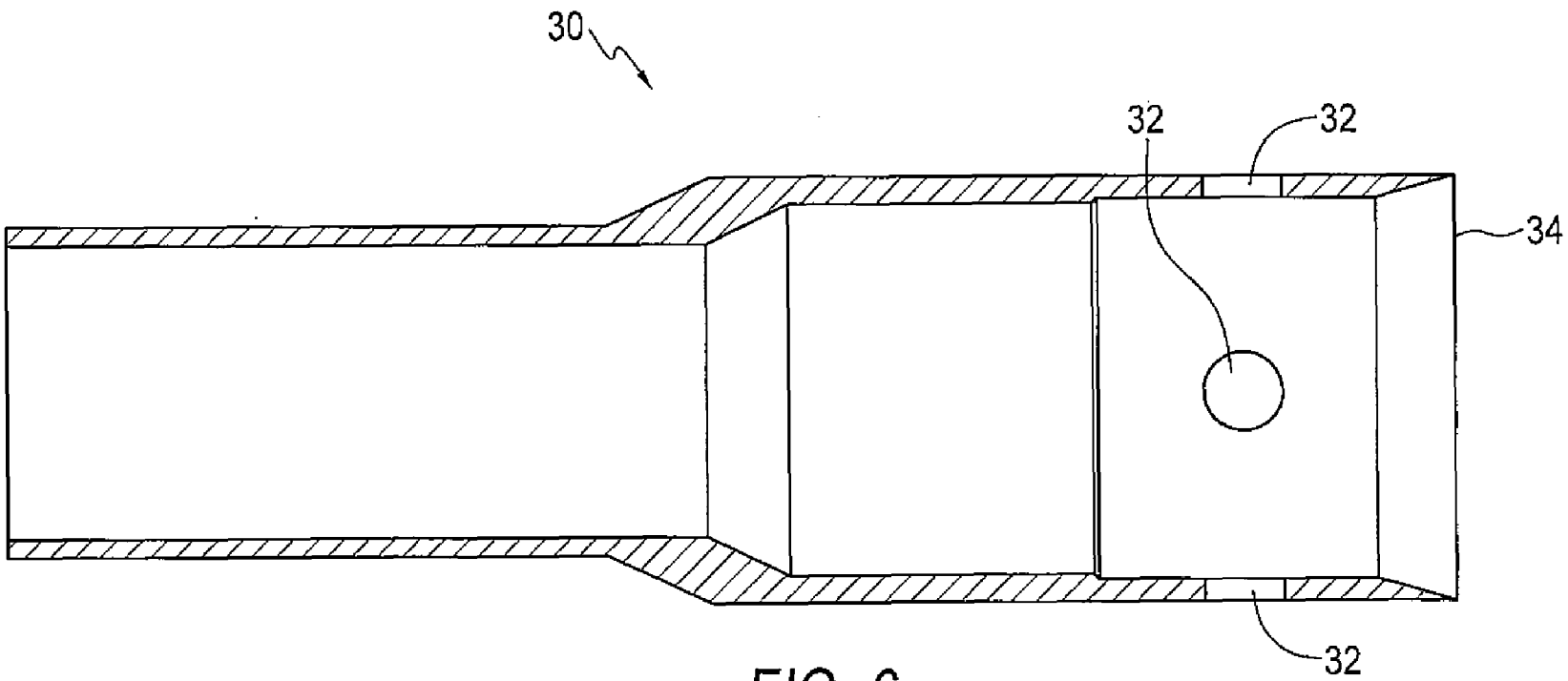
FIG. 6 is a cross-sectional view of a liner hanger of the assembly, according to the invention.

As depicted in FIGS. 5 and 6, the liner hanger 30 comprises a cylindrical component having a wall, a plurality of pin holes 32 proximal to the uphole end 34 of the liner hanger, and means for attachment of the liner hanger to deployable equipment at its downhole end.

Figure 7:
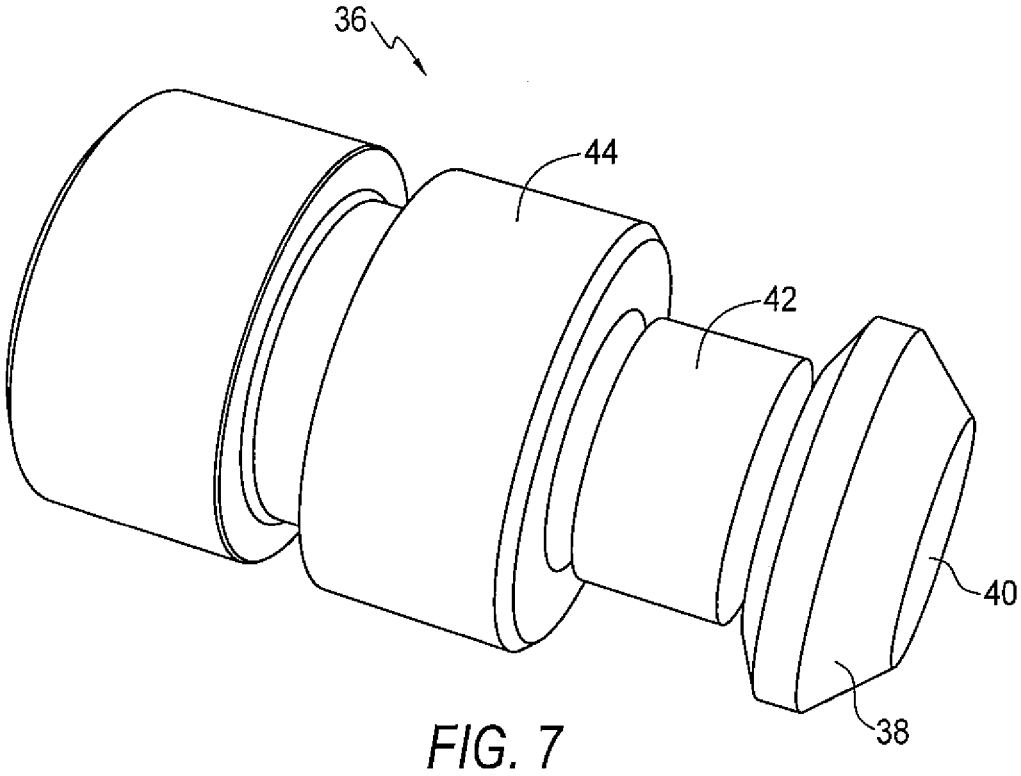
FIG. 7 is a perspective view of a lock pin of the assembly, according to the invention.

As depicted in FIG. 7, the lock pin 36 has a head 38 tapering from a first end 40 of the lock pin to a first pin diameter, the head adjacent a neck 42 having a second pin diameter, and the neck adjacent a shoulder 44 having a third pin diameter. The first pin diameter is less than the width of the pin entrance of each slot and greater than the width of the remainder of each slot. The second pin diameter is less than the width of the remainder of each slot, the third pin diameter is greater than the width of the remainder of the slot and greater than the width of the pin entrance. The tapered head allows the lock pin to enter the pin entrance of the lock piston. The narrower neck may slide freely within the slot, and remains engaged by the wider head and shoulder of the pin.

Figure 8:
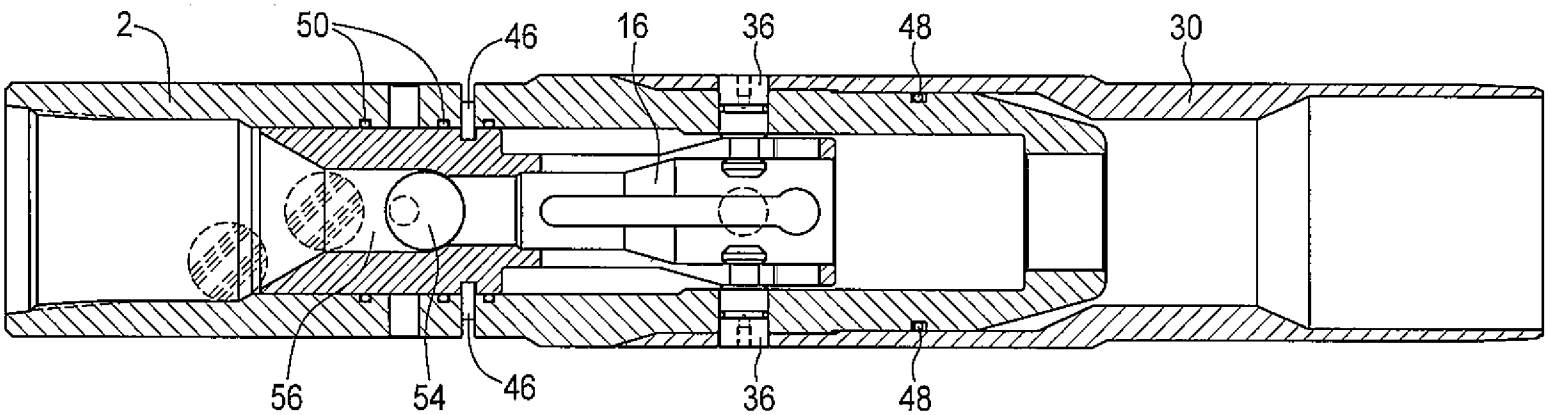
FIG. 8 is a longitudinal cross-sectional view of the assembly of the invention, in a pre-activation position.
Figure 9:
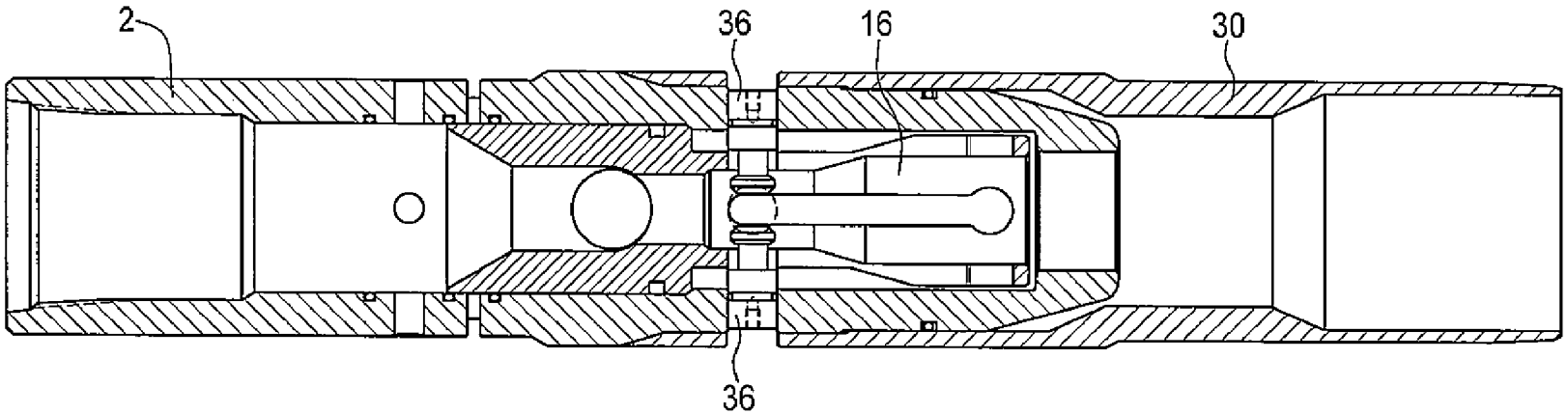
FIG. 9 is a longitudinal cross-sectional view of the assembly of the invention, in an activated position.
Figure 11:
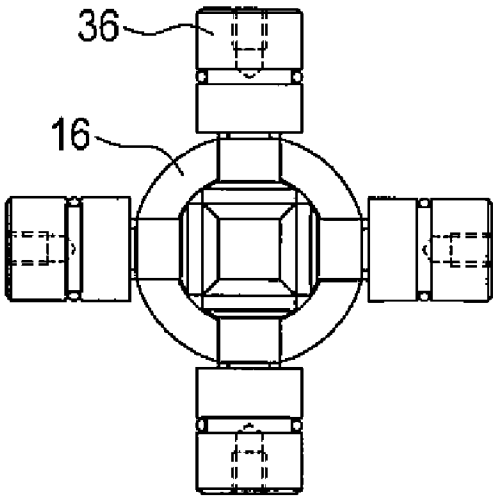
FIG. 11 is a transverse cross-sectional view of the locking pin mechanism of the invention in an activated position.
Figure 10:
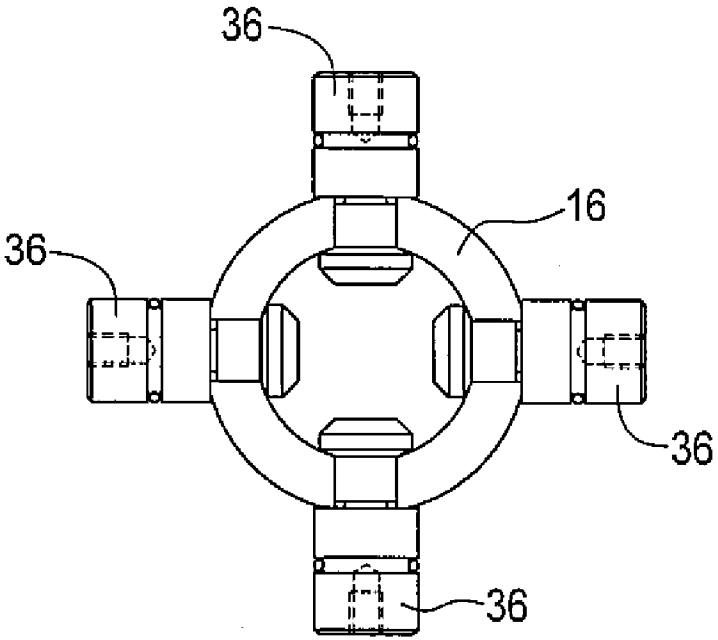
FIG. 10 is a transverse cross-sectional view of the locking pin mechanism of the invention in a pre-activated position.

As depicted in FIG. 8, the assembly according to one embodiment of the present invention includes a top sub 2, a lock piston 16 having a downhole end releasably insertable in the throat of the top sub, a liner hanger 30 for receiving in an uphole end the downhole end of the top sub. In a pre-deployment arrangement, the lock piston may be secured in position within the top sub by shearable screws.

With further reference to FIG. 8, a first phase in operation of the present invention is assembly of the running tool. A top sub may be supplied with a soft seal o-ring 46 and may be inserted through the uphole bore of the liner hanger. The top sub may be supplied with internal soft seals 48. The pin holes of the liner hanger may be aligned with the pin holes of the top sub. The lock piston may be inserted into the throat of the top sub with the collet fingers in a downhole orientation. The lock piston may be rotated to align the slots with the holes of the liner hanger and the top sub.

Soft seals may be assembled onto the lock pin. The look pins may be inserted through the aligned pin holes in the top sub and the liner hanger. In the preferred embodiment having a closed slot design, the lock piston may be positioned with the pin entrance of each slot aligned with a corresponding pin hole of the liner hanger. The lock piston may be pushed further down the throat of the top sub to align the counterbore holes at the uphole end of the lock piston with the threaded holes of the top sub. Brass shear screws 50 may be inserted. The liner hanger may be connected and screwed onto the tubing string.

In operation, the assembly is deployed on a tubing string to a desired depth. In the preferred method of activation, deployment of the assembly may be effected hydraulically using annular string fluid. In a preferred embodiment, the fluid is a liquid, preferably water or a light weight mud. In an alternate embodiment, the hydraulic fluid may be a non-liquid fluid.

First, an activation ball 54 is dropped into the well into proximity with the uphole end of the lock piston. Next, hydraulic fluid from the surface is pumped into the string to seat the ball in the neck 56 of the lock piston. Once the ball is seated, the flow of fluid is blocked, leading to an increase in annulus string pressure to approximately 1005 psig. This hydraulic force causes the shearing of the brass shear screws holding the lock piston in position in the top sub, releasing the lock piston into the top sub.

Lock pins 36 are positioned in a retracted position around the circumference of the top sub. The downhole movement of the lock piston relative to the top sub and liner hanger will cause the lock pins to slide along the slots in the lock piston. The lock pins are spring mounted to move inwardly as the opening in the lock piston moves past the lock pin. Once the pin head is through the opening, the lock pin may not be retracted, as the lock piston has a neck which is narrower than the pin head and the slot, causing the lock pin to be guided along the slot while the lock piston circumference narrows. The narrowing inner circumference of the collet fingers defining the slots will draw the lock pins inwardly from the liner hanger until the innermost ends of the lock pins meet, forming an obstructed bore. The obstructed bore serves to prevent upward flow of debris which could unseat the activation ball. This could reduce hydraulic fluid pressure and prevent tool deployment.

As the pressure of the fluid drives the lock piston deeper into the top sub, the lock piston approaches a narrowed shoulder position in the top sub. In this 'no-go' position, the uphole end of the lock piston is downhole of the fluid drain holes, permitting the pressurized fluid to drain. The momentum of the lock piston will carry it to the no-go shoulder position in the downhole end of the top sub.

Once the lock pins are retracted, the entire assembly, apart from the liner hanger, may be retracted from the hole. Once the tooling is released downhole, the assembly, including the activation ball, is retrieved by pulling the tubing string. The assembly may be quickly inspected, cleaned, redressed and returned to immediate operation if desired. Redressing requirements are usually only one soft seal and four brass shear screws. In the worst case, four elastomers, four brass shear screws and a new activation ball may be required. Only the liner hanger remains with the deployed equipment, minimizing the amount of steel left downhole.

The size of the running tool may vary. The running tool may have a bore corresponding to industry standard bore sizes, for example, 4½ inches, 5½ inches, 6⅝ inches, 7 inches or 9⅝ inches. Other bore sizes are also contemplated to be within the scope of the present invention.

Figure 12:
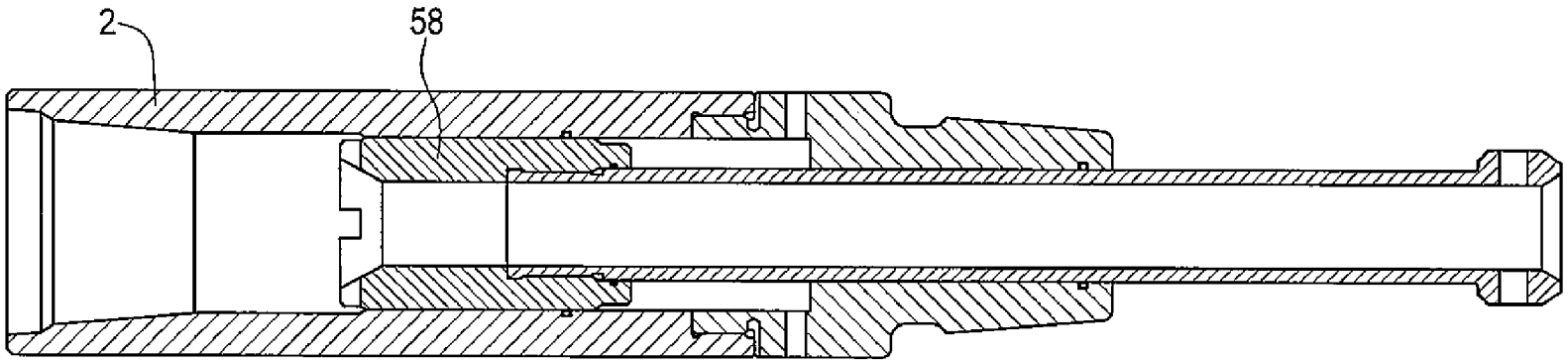
FIG. 12 is a cross-sectional view of a mechanical activation joint of an alternate embodiment of the assembly of the invention.
Figure 13:
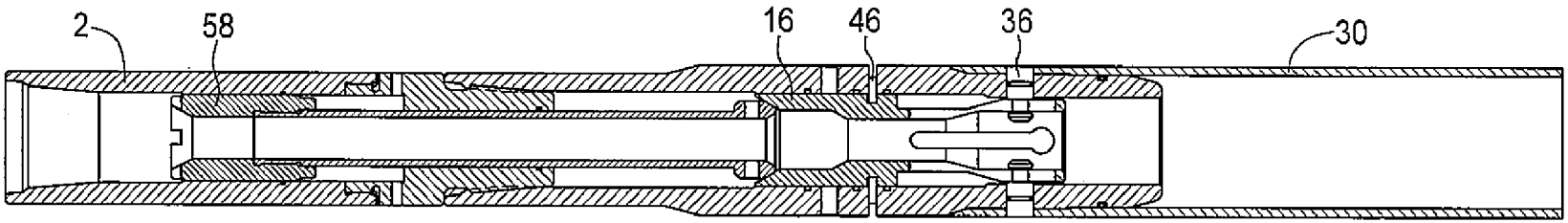
FIG. 13 is a cross-sectional view of the assembly of an alternate embodiment of the assembly of the invention depicting a mechanical activation joint, in a pre-activated position.
Figure 14:
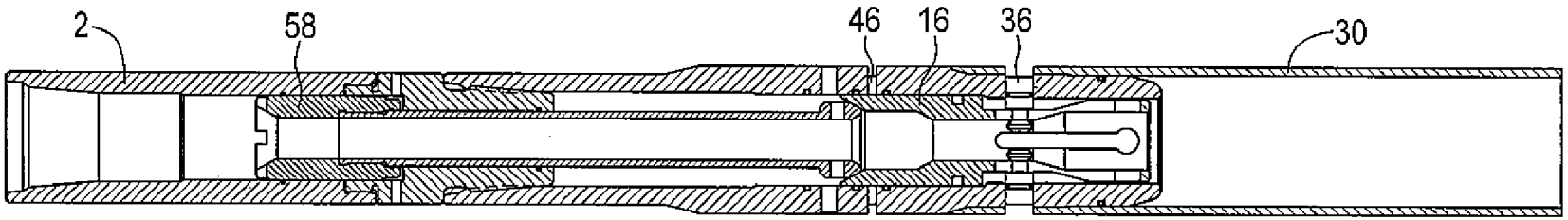
FIG. 14 is a cross-sectional view of the assembly of an alternate embodiment of the assembly of the invention depicting a mechanical activation joint in an-activated position.

In circumstances where hydraulic fluid is not available, or if hydraulic activation fails, the operator may decide to deploy the apparatus manually using mechanical means. In an alternate embodiment of the assembly for mechanical activation, the assembly may further comprise, a mechanical activation joint which may be placed between the tubing string and the hydraulic running tool. As depicted in FIGS. 12-14, the mechanical activation joint comprises a threaded sleeve 58 engageable with the uphole end of the lock piston 16 and in threadable relationship with the inner circumference of the top sub 2. Counterclockwise rotation of the sleeve draws the sleeve in a downhole direction, mechanically forcing the lock piston downhole, thereby shearing the shear screws and passing the slots along the lock pins to retract the lock pins from the liner hanger.

If the assembly is activated mechanically, by operator choice or if the hydraulic deployment fails, the string may be rotated approximately 19 turns counterclockwise, which drives the threaded mandrel into the throat of the top sub, pushing down on the lock piston to move it downhole in the same manner as is affected by hydraulic fluid activation. With the lock piston shifted, the lock pins are retracted from the liner hanger, the tooling is released and the string may be retrieved.

The assembly may be run into a well, understood to be a hole drilled into the earth's surface for the purpose of extraction of composite hydrocarbon petroleum products. The orientation of the well into which the assembly may be run may be substantially vertical, substantially horizontal, or at a deviated angle between substantially vertical and substantially horizontal. The well may be linear or non-linear.

The present invention provides an efficient means of downhole equipment deployment without use of interference devices that impart gripping to the interior bore of the casing/liner. Prior art devices such as slips, dogs and latches introduce frictional interference which assist in preventing axial movement during deployment but are prone to slippage or dragging along the interior bore of the casing, which may cause damage to the casing. In contrast, the present invention makes use of pins which move radially in the well bore, operating perpendicularly to the bore, rather than parallel.

The capacity to deploy the assembly hydraulically or mechanically provides a backup method if hydraulic activation is not possible, thereby reducing the number of missed runs with this assembly. The assembly may be adapted for connection to any equipment meeting industry standards. The assembly of the present invention may be employed in any drilling or completion enterprise, not necessarily limited to oil and gas applications.

It will be appreciated by those skilled in the art that other variations of the preferred embodiment may also be practised without departing from the scope of the invention.

What is claimed is:

1. An assembly for downhole equipment deployment, comprising:

a liner hanger having a wall and a bore, a plurality of pin holes through the wall equidistant from the uphole end of the liner hanger, and means for attachment of the downhole end of the liner hanger to the uphole end of deployable equipment;

a top sub having a wall, a throat section at its downhole end and a plurality of pin holes through the wall in the throat section, the pin holes alignable with the corresponding pin holes of the liner hanger, the downhole end of the top sub insertable into the uphole end of the liner hanger, and the uphole end of the top sub attachable to the downhole end of a string by top sub string attachment means;

a lock piston having at its downhole end a plurality of collet fingers with a slot defined between each pair of adjacent collet fingers, the downhole end of each slot having a pin entrance with a first width greater than the width of the remainder of the slot, each of the pin entrances alignable with corresponding pin holes of the top sub and liner hanger, the lock piston insertable into the throat section of the top sub with the collet fingers oriented downhole, wherein the circumference of the lock piston at the position of the pin entrances is greater than its circumference at the position of the uphole end of the slot;

a plurality of lock pins, insertable through the pin holes of the top sub, the pin holes of the liner hanger, and the pin entrances of the slots of the lock piston;

means for releasably connecting the top sub and the lock piston; and means for remotely releasing the liner hanger from the top sub and the lock piston.

2. The assembly of claim 1 wherein the means for releasably connecting the top sub and the lock piston comprise a plurality of screw holes through the outer wall of the liner hanger, a plurality of corresponding screw holes in the outer surface of the lock piston, and a plurality of shearable screws insertable through the screw holes of the top sub into the screw holes of the lock piston.

3. The assembly of claim 2, wherein the shearable screws are manufactured of brass.

4. The assembly of claim 1 wherein the diameter of the bore is between 4.068 inches and 7.983 inches.

5. The assembly of claim 3 wherein the diameter of the bore is between 4.535 inches and 6.337 inches.

6. The assembly of claim 1 wherein the plurality of pin holes in the liner hanger and the top sub comprises four pin holes.

7. The assembly of claim 1 wherein the means for attachment of the downhole end of the liner hanger to the uphole end of deployable equipment includes a threaded male (pin) connection.

8. The assembly of claim 1 wherein the top sub string attachment means include a threaded female (box) connection.

9. The assembly of claim 1 wherein the plurality of collet fingers comprises four collet fingers.

10. The assembly of claim 1 wherein the downhole ends of the collet fingers of the lock piston join to form an annular downhole lock piston terminus.

11. The assembly of claim 1 wherein the means for remotely releasing the liner hanger from the top sub and the lock piston comprises mechanical means.

12. The assembly of claim 1 wherein the mechanical means for remotely releasing the liner hanger from the top sub and the lock piston comprises a mechanical activation component disposed between the uphole end of the top sub and the downhole end of the string, the mechanical activation component threadably insertable into the top sub to effect release of the lock piston from the top sub.

13. The assembly of claim 11 wherein the means for remotely releasing the liner hanger from the top sub and the lock piston comprises hydraulic means.

14. The assembly of claim 12 wherein the top sub further comprises at least one hydraulic fluid drain disposed in a position which is downhole of the uphole end of the lock piston when the lock piston is in a pre-activation position, and uphole of the uphole end of the lock piston when the lock piston is substantially in an activated position;

the hydraulic activation means comprises an activation ball disposable into the hole to a position in proximity to the uphole end of the lock piston; and a supply of pressurized hydraulic fluid for seating the ball in the mouth of the lock piston.

15. A method of operating a running tool assembly for deploying downhole equipment from the surface, comprising the following steps:

assembling a liner hanger, top sub, lock piston, lock pins, shear screws and seals into a running tool assembly;

attaching the assembly to a tubing string;

inserting the assembly into a selected hole to a desired depth;

dropping an activation ball downhole;

pumping hydraulic fluid from the surface to seat the ball, increase annulus string pressure, shear screws holding the lock piston to the top sub, drive the lock piston into the liner hanger, and retract the lock pins holding the liner hanger to the top sub;

retrieving the assembly apart from the liner hanger by pulling the tubing string out of the hole.

16. The method of operating a running tool assembly of claim 15, further comprising the additional final step of refitting the assembly.

17. The method of claim 15, wherein the hydraulic fluid is in a gas phase.

18. A method of operating a running tool assembly for deploying downhole equipment from the surface, comprising the following steps:

assembling a liner hanger, top sub, lock piston, lock pins, shear screws and seals into a running tool assembly;

attaching the assembly to a tubing string;

inserting the assembly into a selected hole to a desired depth;

rotating the string to mechanically shear screws holding the lock piston to the top sub, drive the lock piston into the liner hanger, and retract the lock pins holding the liner hanger to the top sub;

retrieving the assembly apart from the liner hanger by pulling the tubing string out of the hole.

* * * * *